US012584366B2

(12) United States Patent
Cody et al.

(10) Patent No.: US 12,584,366 B2
(45) Date of Patent: Mar. 24, 2026

(54) ARRANGED PROFILED PLATES AND LOAD RELIEF PLATES FOR OILFIELD EQUIPMENT

(71) Applicant: Baker Hughes Pressure Control LLC, Houston, TX (US)

(72) Inventors: Paul Cody, Houston, TX (US); Wei He, Houston, TX (US); Brian Munk, Houston, TX (US); Mahesha Udipi, Houston, TX (US)

(73) Assignee: Baker Hughes Pressure Control LLC, Houston, TX (US)

( * ) Notice: Subject to any disclaimer, the term of this patent is extended or adjusted under 35 U.S.C. 154(b) by 0 days.

(21) Appl. No.: 18/105,536

(22) Filed: Feb. 3, 2023

(65) Prior Publication Data

US 2024/0263533 A1 Aug. 8, 2024

(51) Int. Cl.
*E21B 33/04* (2006.01)

(52) U.S. Cl.
CPC ..... *E21B 33/0422* (2013.01)

(58) Field of Classification Search
CPC ..... E21B 33/02; E21B 33/03; E21B 33/04; E21B 33/0422
See application file for complete search history.

(56) References Cited

U.S. PATENT DOCUMENTS 4,353,560 A 10/1982 Tohill
4,489,916 A 12/1984 Stevens
4,759,409 A 7/1988 Gullion
5,031,696 A 7/1991 Zwiegel
6,015,009 A * 1/2000 Allen ..... E21B 33/047 166/89.3
6,644,401 B1 11/2003 Miller
8,061,419 B2 11/2011 Khazanovich
2012/0285676 A1 11/2012 Shaw
2013/0000920 A1* 1/2013 Duong ..... E21B 33/043 166/368
2013/0146306 A1 6/2013 Yates
2014/0062025 A1* 3/2014 Hoang ..... E21B 33/04 277/328

FOREIGN PATENT DOCUMENTS

CN 106321007 A 1/2017
CN 216950305 7/2022
WO 2013/158031 10/2013

OTHER PUBLICATIONS

Yong Chen et al., "Investigation on the Depth of Slip Hanger Teeth Bite into Casing and the Mechanical Properties of Casing under Different Suspension Loads in Ultra-Deep Wells," Oct. 2021, Strojniki vestnik—Journal of Mechanical Engineering, vol. 67, pp. 516-524.

(Continued)

*Primary Examiner* — Nicole Coy
(74) *Attorney, Agent, or Firm* — Law Office of Darin Duphorne, PLLC

(57) ABSTRACT

In at least one embodiment, a system for a slip hanger or packoff to be used with oilfield equipment is disclosed. The system includes an arrangement of one or more load relief plates to be above or below one or more profiled plates, the one or more profiled plates having a profile that induces a change in shape in the one or more load relief plates under a load applied to the slip hanger or the packoff.

20 Claims, 11 Drawing Sheets

(56) References Cited

OTHER PUBLICATIONS

JS Wellhead Co., Ltd., "Slip Casing Hangers," Nov. 8, 2022, http://www.jswellhead.com/Products/C-21-and-C-21-P-Manually-Energized-Seal-Slip-Type-Casing-Hanger.html, 7 pages.
International Search Report and Written Opinion issued in PCT Application No. PCT/US2024/013434, mailed May 24, 2024 (10 pages).

* cited by examiner

ARRANGED PROFILED PLATES AND LOAD RELIEF PLATES FOR OILFIELD EQUIPMENT

BACKGROUND

1. Technical Field

This disclosure relates generally to oilfield equipment and more particularly to systems and methods for an arrangement of profiled plates and load relief plates for a slip hanger or a packoff.

2. Description of the Prior Art

A slip hanger, such as a manual slip hanger, is a type of wellhead equipment used with oilfield equipment to support the weight of casing strings in a wellbore. The slip hanger may be installed within the wellhead and may include a series of slips that grip a casing string. A housing may be provided to hold the slips in place. Further, a mechanism may be provided within the slip hanger for releasing and setting the slips. The slip hanger may be used in conjunction with a casing head, which may be a flanged fitting attached to a wellhead. The casing head includes a bore that may be slightly larger than the casing string, which allows the casing string to be run through it. The slip hanger may be placed within casing head and the slips may be set to grip the casing string. For removal of the casing string, the slips may be released by releasing the slip hanger and the casing string can be pulled out of the wellbore. In a similar manner, a packoff is a mechanical seal used in oilfield equipment to prevent fluid leakage between sections of the equipment, such as to seal connections between the production tubing and the wellhead. There may be more than a hundred individual components associated with the slip hanger or the packoff to enable their functioning.

SUMMARY

In at least one embodiment, a system for a slip hanger or a packoff to be used with oilfield equipment includes an arrangement of one or more load relief plates to be above or below one or more profiled plates. The one or more profiled plates include a profile that induces a change in shape in the one or more load relief plates under a load applied to the slip hanger or the packoff.

In at least one embodiment, a method for a slip hanger or a packoff to be used with an oilfield equipment includes providing one or more profiled plates with a profile that induces a change in shape in one or more load relief plates under a load applied to the slip hanger or the packoff. The method includes enabling an arrangement of the one or more load relief plates above or below the one or more profiled plates. The method also includes associating together the arrangement to provide the slip hanger or the packoff.

In at least one embodiment, a method for using a slip hanger or a packoff in an oilfield equipment includes determining a predetermined resistance and predetermined stress differences to be addressed by the slip hanger or the packoff in an application for the slip hanger or the packoff in the oilfield equipment. The method includes selecting one or more load relief plates and one or more profiled plates to be associated together based in part on the determining of the predetermined resistance and the predetermined stress differences to be addressed. The method includes associating together the one or more load relief plates and one or more profiled plates for use in the oilfield equipment.

BRIEF DESCRIPTION OF DRAWINGS

Some of the features and benefits of the present disclosure having been stated, others will become apparent as the description proceeds when taken in conjunction with the accompanying drawings, in which.

Figure 1:
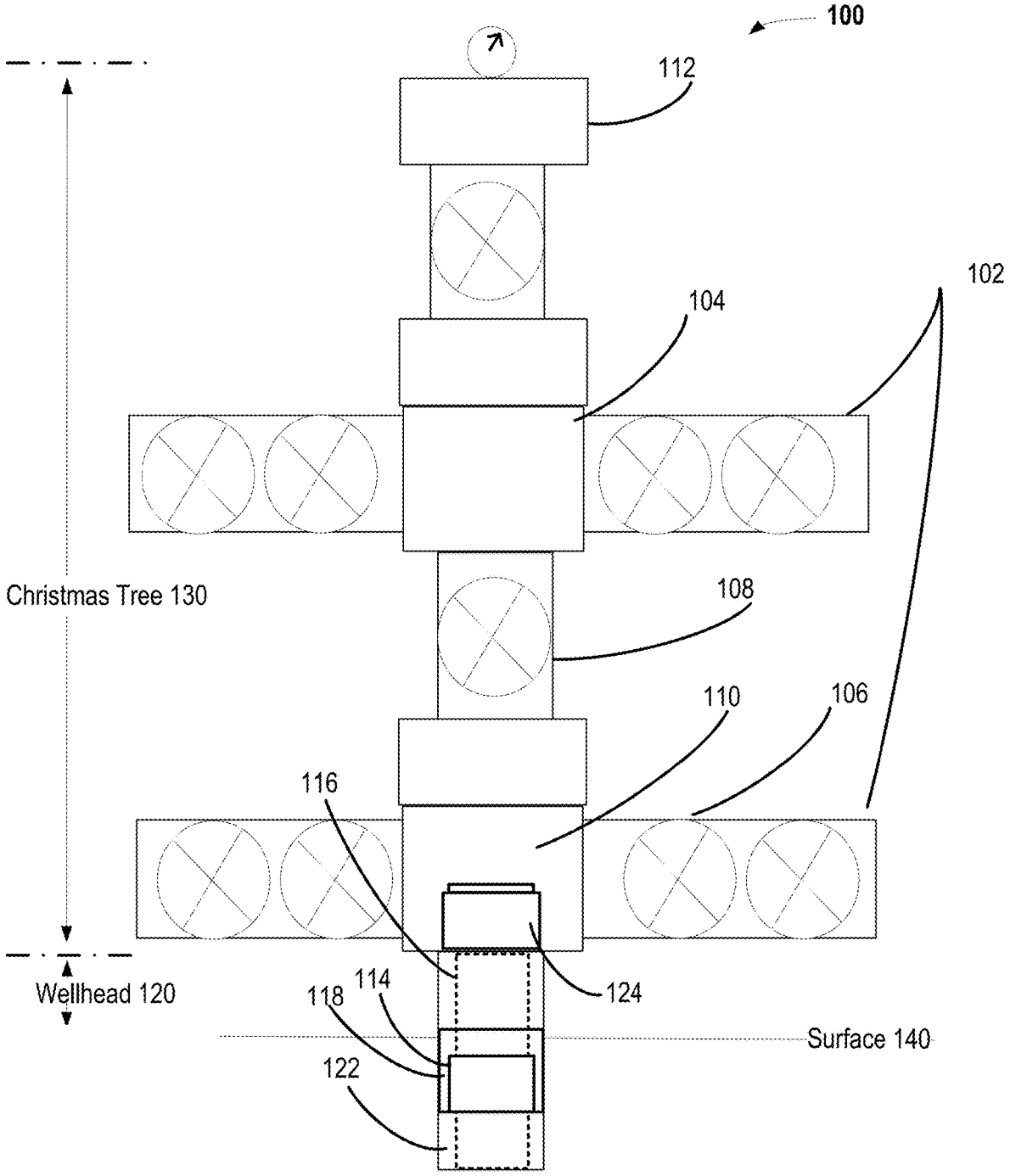
FIG. 1 is a block diagram of certain oilfield equipment that is subject to an arrangement of profiled plates as detailed herein and in accordance with at least one embodiment.

While the disclosure will be described in connection with the preferred embodiments, it will be understood that it is not intended to limit the disclosure to that embodiment. On the contrary, it is intended to cover all alternatives, modifications, and equivalents, as may be included within the spirit and scope of the disclosure as defined by the appended claims.

DETAILED DESCRIPTION

The foregoing aspects, features and advantages of the present technology will be further appreciated when considered with reference to the following description of preferred embodiments and accompanying drawings, wherein like reference numerals represent like elements. In describing the preferred embodiments of the technology illustrated in the appended drawings, specific terminology will be used for the sake of clarity. The present technology, however, is not intended to be limited to the specific terms used, and it is to be understood that each specific term includes equivalents that operate in a similar manner to accomplish a similar purpose.

In at least one embodiment, to resolve issues described above, profiled plates are aligned to be above or below one or more load relief plates. The profiled plates may also be at least an upper profiled plate and a lower profiled plate of a slip hanger or a packoff. The profiled plates allow a load relief plate to have a spring mechanism to relieve high loads caused by thermal expansion on a slip hanger seal, such as of a manual slip hanger seal. The profiled plates may be used with one or more load relief plates above or below the profiled plates. In at least one embodiment, a compression seal, such as a manually energized compression seal or a packoff, may be included with the profiled plates or the load relief plates. In at least one embodiment, while the load relief plates are capable of acting as springs, the upper profiled plate, the lower profiled plate, and the middle profiled plates have relatively less spring capability than the load relief plates.

In at least one embodiment, the slip hanger includes a manually energized compression seal that is either above or below the arrangement of the one or more load relief plates and the one or more profiled plates. In at least one embodiment, an arrangement of the profiled plates and the load relief plates allow a range of application temperatures and pressures to be achieved for a slip hanger or a packoff. The arrangement may include stacks of one or more load relief plates above or below one or more relief plates. The profiled plates, whether upper, middle, or lower, may include a profile that induces a change in shape in the load relief plates under load.

In at least one embodiment, adjusting a height, a span, a number, and/or relative placement configuration of one or more load relief plates or of one or more profiled plates, allows compliance and working deflection between the profiled plates and the load relief plates to be customized to meet application needs for the slip hanger or the packoff. In at least one embodiment, such customization allows for thermal expansion relief caused at least because of the application temperatures and pressures in different applications. There may be fixed angular space or angular areas, such as caused by the profile of the profiled plates relative to the load relief plates, available around the compression seal as part of the arrangement described herein for the slip hanger or the packoff.

In at least one embodiment, this allows for the profiled plates to induce a change in shape, such as a deformation for one or more load relief plates, in a vertical orientation, a radial orientation, a circumferential orientation, or a combination of two or more of such orientations. In at least one embodiment, this arrangement also to reduce a number of parts used from hundreds to within single digits. For example, the hundreds of parts used in a slip hanger or a packoff may have included conical disc springs to be used with a screw in a slip hanger; however, in at least one embodiment herein, multiple angular areas may be enabled by the one or more load relief plates and the one or more profiled plates, which all extend circumferentially to provide the multiple angular areas in different circumferentially positions, such as at each screw hole of multiple screw holes.

In at least one embodiment, a system of a slip hanger or a packoff having an arrangement of profiled plates includes a stacking in a compliant mechanism, without having to focus on a specific up or down orientation of a profile of the profiled plates against the load relief plates. This at least removes from a requirement to arrange the hundreds of parts in specific orientations that may contribute to installation error and are limited by mass and allowable material strain. A system of a slip hanger or a packoff having an arrangement of profiled plates also addresses empty angular space and other mechanisms relying on expensive materials to handle higher strains or a taller stack of material associated with a slip hanger or a packoff.

In at least one embodiment, a profile of the profiled plates induces a change in shape in the load relief plates, where the change in shape is not centered or symmetric. For example, the profile of the profiled plates allow distortion or deformation in the load relief plates in a vertical orientation or manner, in a circumferential orientation or manner, in a radial orientation or manner, or in a combination of two or more of the vertical, the circumferential, or the radial orientations or manners described herein.

In at least one embodiment, a system of a slip hanger or a packoff having an arrangement of profiled plates can achieve highly customizable compliance with part geometry that is simple to manufacture by machining and with common materials understood to a person of ordinary skill upon reviewing this disclosure. The arrangement herein, in at least one embodiment, does not have a specific up-or-down orientation that may be a source of installation error for other compliant mechanisms, such as conical disc springs. As a result, a system of a slip hanger or a packoff having an arrangement of profiled plates provides compliance that can be used to reduce sensitivity to dimensional tolerances or thermal changes across a wide range of applications, such as limiting temperature sensitivity of a manual slip hanger compression seal.

FIG. 1 is a block diagram of oilfield equipment 100 that is subject to system of a slip hanger having an arrangement of profiled plates as detailed herein and in accordance with at least one embodiment. The oilfield equipment 100 may include a Christmas tree 130 over a wellhead 120 located at or about a surface layer 140. The Christmas tree 130 may include on one or more branches 102 having valves thereon of the oilfield equipment 100.

Further, as illustrated in FIG. 1, oilfield equipment 100 may include a top connector 112 that is connected at a top of a studded cross 104. There may be multiple flow line gate valves and multiple kill line gate valves, generally illustrated as valves 106. These valves 106 may be on opposite sides of a studded cross 104. Further, the oilfield equipment may include one or more master gate valves 108, such as an upper and a lower master gate valve. A tubing head adapter may be connected between a tubing head 110 and at least one of the master gate valves 108.

In at least one embodiment, a system 114 of a slip hanger having an arrangement of profiled plates may be used to perform operations associated with a casing string 116 and may be located within a casing hanger spool 118. In at least one embodiment, further, a system 124 of a slip hanger having an arrangement of profiled plates may be used to perform operations associated with a casing string 116 and may be located within a tubing head 110 of the oilfield equipment 100.

In at least one embodiment, a system of a slip hanger having an arrangement of profiled plates may be used with other hangers, including a tubing hanger associated with a tubing, a production casing hanger associated with a production casing, or an intermediate casing hanger associated with an intermediate casing. Therefore, the illustrated casing string 116 may be a series of concentric casing and tubing, each having an independent hanger that may benefit from the present system of a slip hanger having an arrangement of profiled plates.

In at least one embodiment, a casing string may line walls of a wellbore and may be supported by a slip hanger 114 mounted to a wellhead 120, but associations to one or more of a slip hanger spool 118 or another feature. The slip hanger may be referred to also as a casing hanger. In at least one embodiment, wedge-shaped slips may be provided for coupling between the slip hanger and the casing string 116. Further, seal assemblies may be provided for preventing pressure communication and may be provided between the casing string 116 and wellhead 120.

In at least one embodiment, a system 114 of a slip hanger or a system 124 of a packoff may include an upper profiled plate and a lower profiled plate to sandwich the profiled plates and the load relief plates, along with the compression seal. The system 114 may be coupled together with screws, including threaded studs. These threaded studs may be torqued to an amount that causes the profiled plates and the load relief plates to axially compress to provide sealing for the casing string 116 and wellhead 120. In at least one embodiment, instead of the threaded studs, the upper profiled plate, the lower profiled plate, the profiled plates, and the load relief plates may be associated together by an internal lockdown. The internal lockdown may include other types of screws, such as lock screws without the aligned stud holes.

Figure 2:
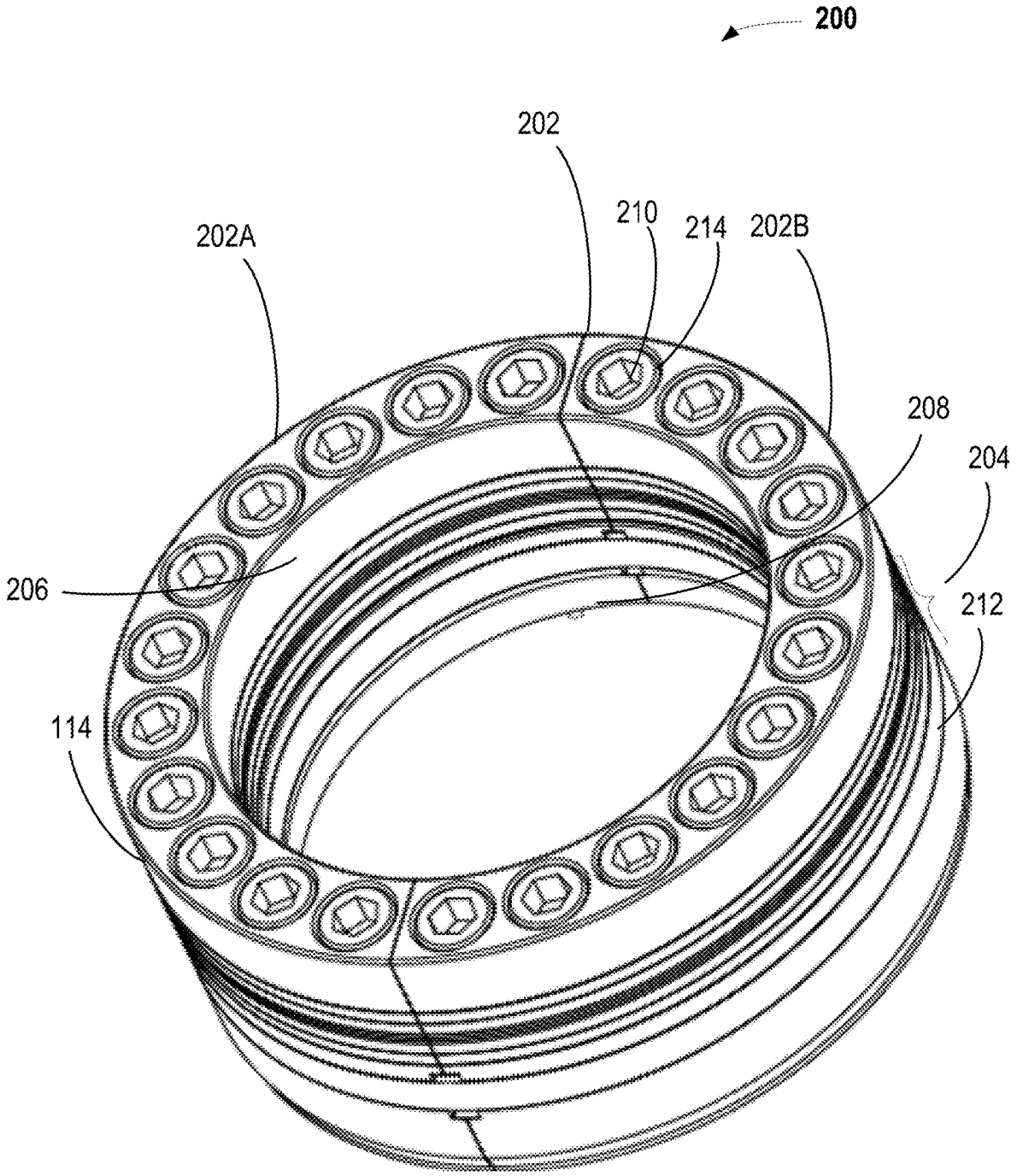
FIG. 2 is a perspective view of aspects of a system of a slip hanger having an arrangement of profiled plates in accordance with at least one embodiment.

FIG. 2 is a perspective view of aspects 200 of a system 114 of a slip hanger or a system 124 of a packoff having an arrangement of profiled plates 204, in accordance with at least one embodiment. In at least one embodiment, the system 114 is also referred to as seal assembly and the system 114; 124 is made up of an upper profiled plate 206 and an annular lower profiled plate 208, which can be a slip bowl. Each of the upper profiled plate and the lower profiled plate are formed by joining together a pair of semi-circular members, generally referred under the sections 202A, 202B. The section 202A, 202B are joined at a split 202. The upper profiled plate 206 is coaxial with the lower profiled plate 208 and includes a compression seal 212.

In at least one embodiment, the compression seal 212 may be also bisectional having semi-circular members, along the sections 202A, 202B, joined together along a split 202. Further, in at least one embodiment, the arrangement 204 of profiled plates and load relief plates may be provided also within the sections 202A, 202B and may be joined at the split 202. Example materials for the upper profiled plate 206, the lower profiled plates 208, profiled plates, and the load relief plates include elastic materials, such as carbon steel or stainless steel, whereas the compression seal 212 may be of an elastomer material. In at least one embodiment, such elastomer may include hydrogenated nitrile butadiene rubber (HNBR) or Polyether ether ketone (PEEK). In at least one embodiment, the profiled plates can help to achieve a good seal at a low temperature. This is at least because a strain energy stored in the profiled plates and the load relief plates, at an ambient temperature, may be released at the low temperature to compensate for thermal contraction of the elastomer material.

In at least one embodiment, the sections are axially fastened together from the upper profiled plate 206 to the lower profiled plate using screws 210 that are threaded and that thread into a screw hole, through the arrangement 204 of profiled plates and load relief plates, and through the compression seal 212. Even though illustrated below the arrangement 204, the compression seal 212 may be above the arrangement 204, in at least one embodiment. The screws 210 are illustrated as hexagonal headed socket but may be any suitable lock screws or studs used to bring together the arrangement of the upper profiled plate 206, lower profiled plate 208, the arrangement 204 of profiled plates and load relief plates, and the compression seal 212.

Figure 3A:
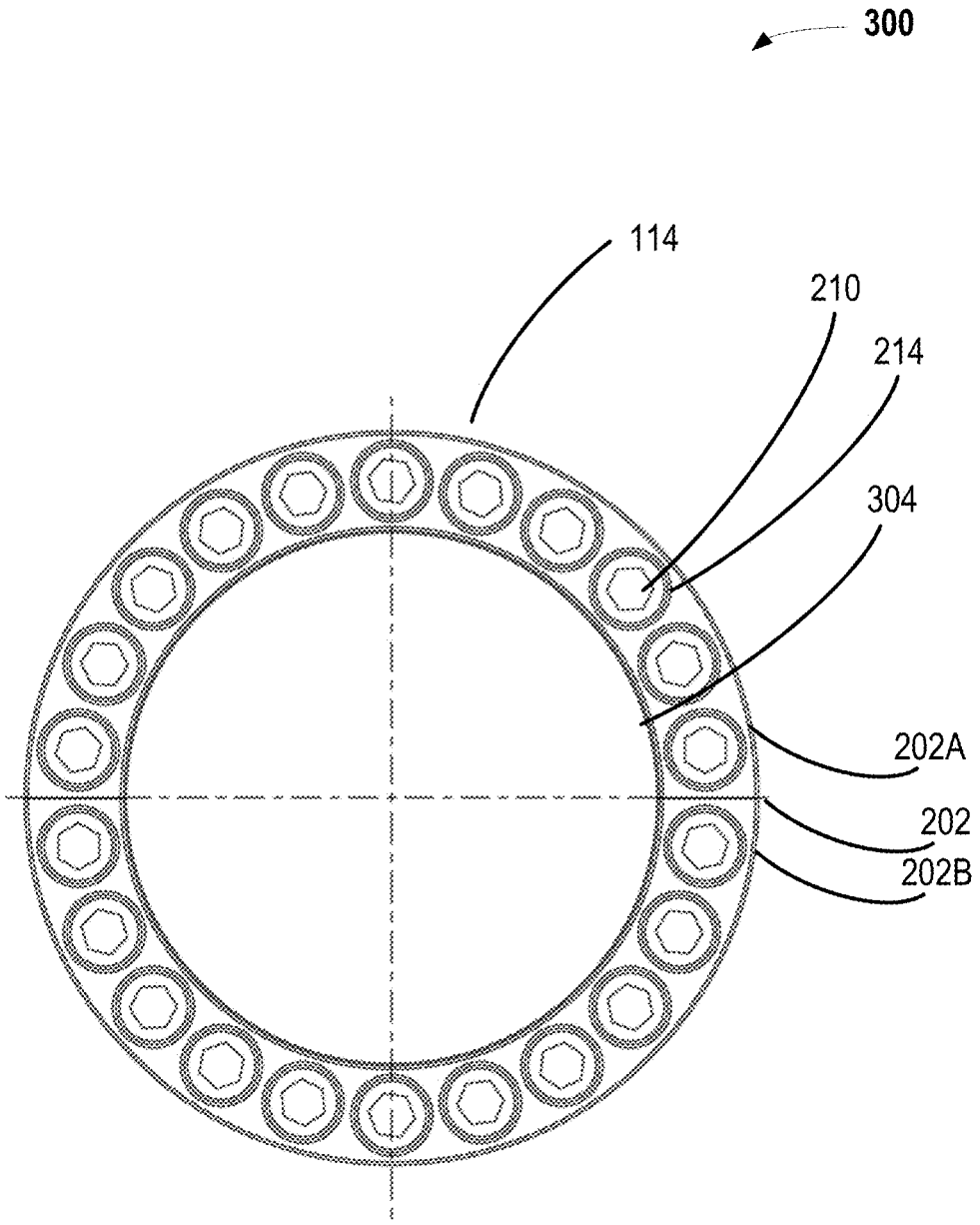
FIG. 3A is a top view of aspects of a system of a slip hanger or a packoff having an arrangement of profiled plates in accordance with at least one embodiment.

FIG. 3A is a top view of aspects 300 of a system 114 of a slip hanger or a system 124 of a packoff having an arrangement of profiled plates in accordance with at least one embodiment. The sections 202A, B illustrated in FIG. 3A are axially fastened together from an upper profiled plate 206 to a lower profiled plate 208 using screws 210 that are threaded and that thread into a screw hole 302. The screws 210 are illustrated as hexagonal headed socket for example purposes. FIG. 3A also illustrates that the system 114 includes an area 304 to allow mounting of the system over a casing string 116. In at least one embodiment, the system 114 for a slip hanger is mounted on a casing string 116 lowered into a wellhead 120 to support the weight of casing string 116 in the wellbore 122.

Figure 3B:
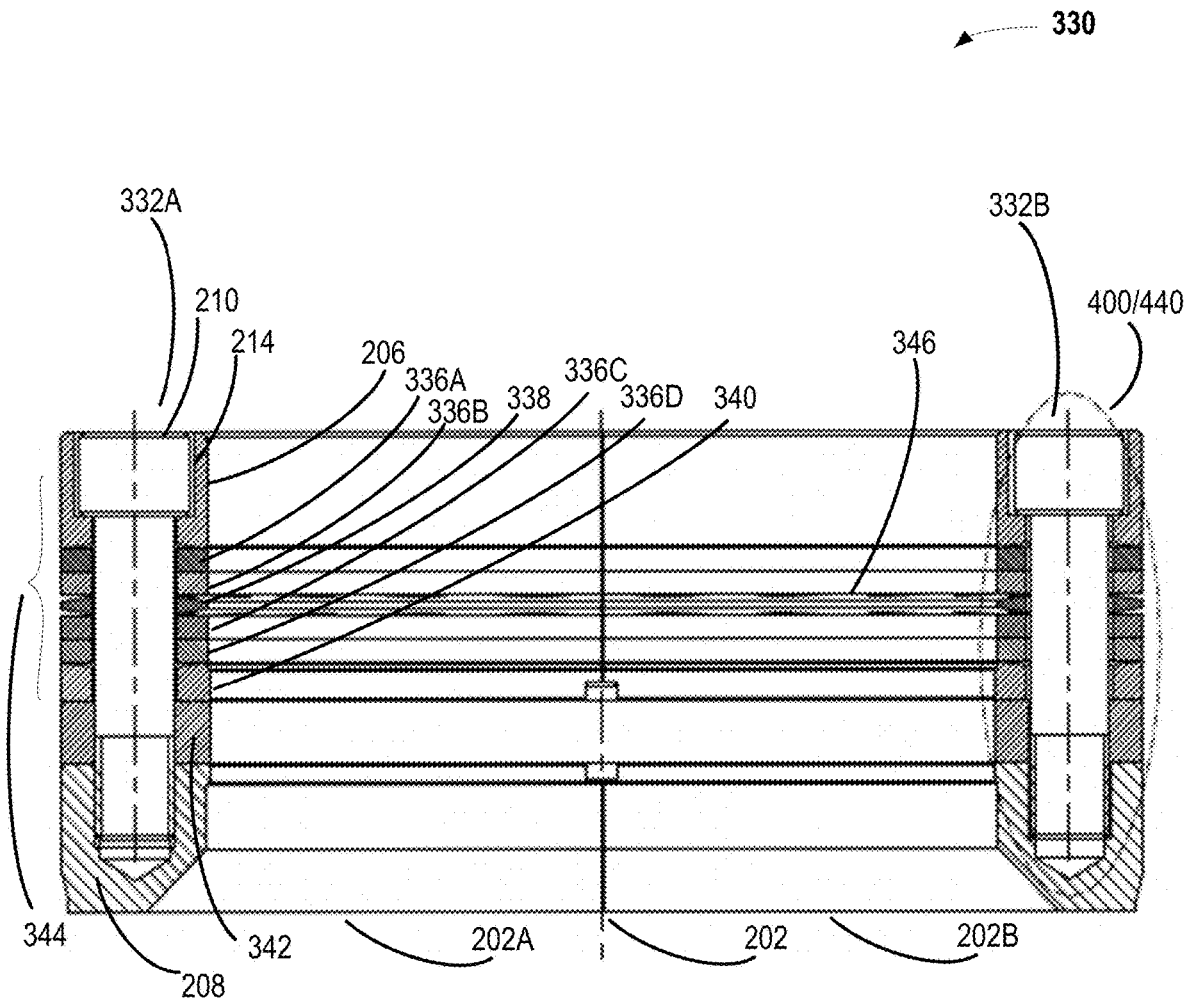
FIG. 3B is a cross-sectional view of aspects of a system of a slip hanger or a packoff having an arrangement of profiled plates in accordance with at least one embodiment.

FIG. 3B is a cross-sectional view of aspects 330 of a system of a slip hanger or a packoff having an arrangement of profiled plates in accordance with at least one embodiment. The sections 202A. B illustrated in FIG. 3B are axially fastened together from an upper profiled plate 206 to a lower profiled plate 208 using screws 210 that are threaded and that thread into a screw hole 332. FIG. 3B also illustrates that a first area 332A of a first section 202A that is opposite to a second area 332B of a second section 202B and that the screw holes 332 are in an alignment in the first and second areas 332A, B. However, as there are many such individual screw holes in each of the at least two sections 202A, B, they are all aligned to allow for respective screws 210 to thread into the screw holes and to anchor at least between the upper profiled plate 206 and the lower profiled plate 208.

In at least one embodiment, the areas 332A, B having the screw holes 332 are associated with the profile 346 in each of the profiled plates, such as a middle profiled plate 338 and such as the upper profiled plate 206 and a lower profiled plate 340. As described further with respect to at least FIGS. 4A-4D, the profile 346 may be one or more sides of a profiled plate and may include one or more convex and/or other profiled indentations 348. For example, in at least one embodiment, the profiled indentations may be other non-uniform or uniform indentations may be used that are eccentric and induce non-uniform or uniform change in shape in the associated load relief plates. In at least one embodiment, the indentations 348 of a profiled plate are adjacent to respective screw holes 332 or may be within respective screw holes 332 of the profiled plate.

In at least one embodiment, a system 114 of a slip hanger or a system 124 of a packoff to be used with oilfield equipment therefore includes an arrangement 344 of one or more load relief plates 206, 338, 340 to be above or below one or more profiled plates 206, 338, 340. The one or more profiled plates 206, 338, 340 include a profile 346 that induces a change in shape in the one or more load relief plates 336A-D because of at least the indentations 348 and because of a load applied to the slip hanger or a packoff. For example, the load may be from the screws being tightened prior to application in a wellhead or may be from supporting the weight of casing string in the wellhead.

In at least one embodiment, a manually energized compression seal 342 may be located adjacent to the arrangement 344. The manually energized compression seal 342 may include an elastomer material. The system 114 of a slip hanger or the system 124 of a packoff may include the one or more load relief plates 336A-D to a change in shape, such as in a vertical orientation. Further, the one or more load relief plates 336A-D and the one or more profiled plates 206, 338, 340 extend circumferentially in the slip hanger to accommodate multiple screws 210 and to associate together the arrangement 344 for the slip hanger in a sandwich between the lower profiled plate 208 and the upper profiled plate 206, where the upper profiled plate 206 may be a profiled plate by virtue of indentations 348 in a bottom side profile of the upper profiled plate.

The system for a slip hanger (or separately, a packoff) may include the one or more load relief plates 336A-D and the one or more profiled plates 206, 338, 340 to be interchangeable and to be based in part on an application of the slip hanger or the packoff. This allows for customization, such as to enable different heights, spans, numbers, or relative placement configuration of the one or more load relief plates or of the one or more profiled plates, to be adjustable to enable compliance and deflection that are customized in accordance with an application of the slip hanger.

The system for a slip hanger (or separately, a packoff) may be such that the one or more load relief plates 336A-D enable resistance and stress differences. Further, the one or more profiled plates 206, 338, 340 can enable compliance for the arrangement 344 under the load applied to the slip hanger. In at least one embodiment, the system 114 for a slip hanger is such that the profile 346 of the one or more profiled plates 206, 338, 340 includes the one or more convex or profiled indentations 348.

The system for a slip hanger (or separately, a packoff), in at least one embodiment, is such that the one or more profiled plates 206, 338, 340 is at least an upper profiled plate 206 and a lower profiled plate 340. The upper profiled plate is adjacent to respective heads (such as the hexagonal heads) of the screws 210 to associate together the arrangement 344 in the slip hanger. The lower profiled plate 340 is adjacent to a manually energized compression seal 342.

Figure 3C:
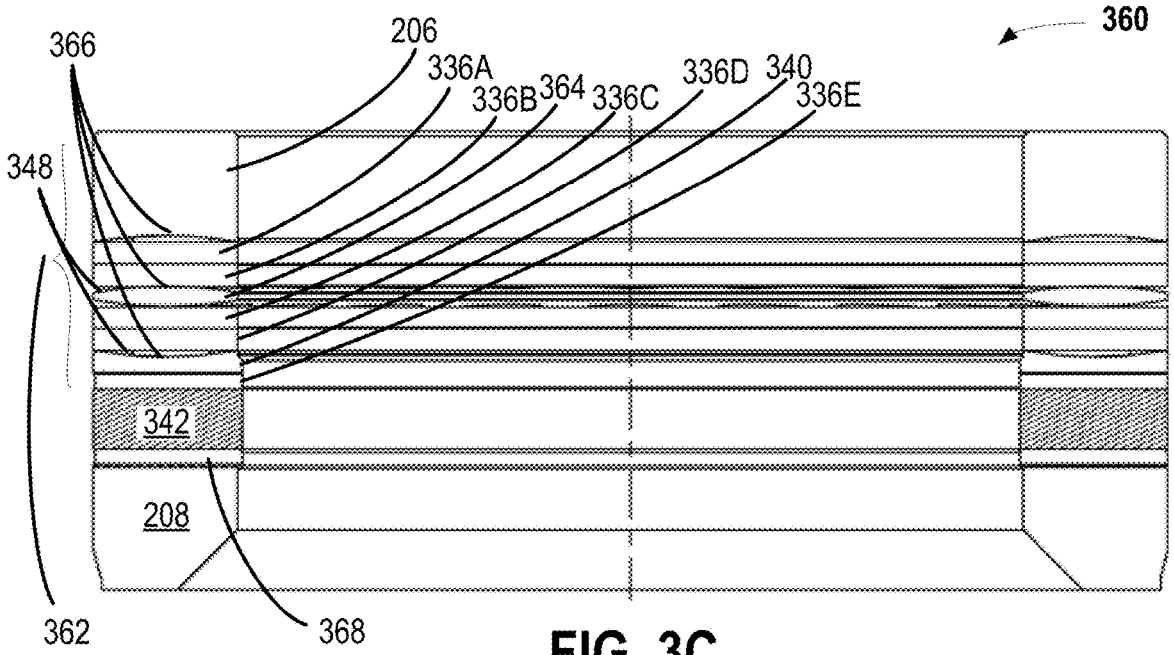
FIG. 3C is a cross-sectional view showing first angular details of a system of a slip hanger or a packoff having an arrangement of profiled plates, in accordance with at least one embodiment.

FIG. 3C is a cross-sectional view showing first angular details 360 of a system of a slip hanger or a packoff having an arrangement of profiled plates, in accordance with at least one embodiment. In at least one embodiment, a system 114 for a slip hanger (or separately, a packoff) to be used with oilfield equipment therefore includes an arrangement 344 of one or more load relief plates 336A-D to be above or below one or more profiled plates 206, 338 (or 364), 340. The one or more profiled plates 336A-D include a profile 346 that induces a change in shape in the one or more load relief plates 336A-D because of at least the indentations 348 and because of a load applied to the slip hanger. For example, the respective indentations 348 have a curved apex 366 as part of the first angular details 360.

In at least one embodiment, the profiled plates may include alternated indentations on an upper profiled plate and on a profiled plate having at least one load relief plate therebetween. This is to induce a change in shape that is a circumferential 'wave' shape in the load relief plates. In at least one embodiment, the indentations 348 can include an angle apex, a flat bottom, different angled apex, multiple convex indentations, an offset convex indentation, a saw-tooth profile, or a radial wave profile with two or more indentations.

Figure 3D:
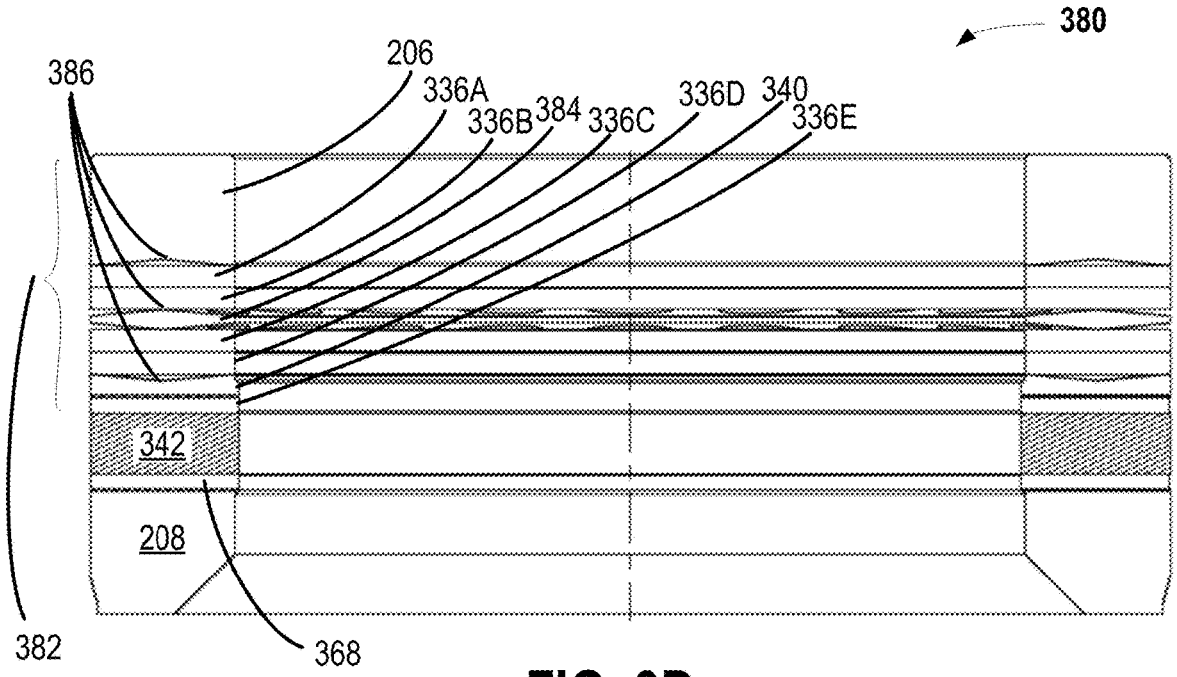
FIG. 3D is a cross-sectional view showing second angular details of a system of a slip hanger or a packoff having an arrangement of profiled plates, in accordance with at least one embodiment.

FIG. 3D is a cross-sectional view showing second angular details 380 of a system of a slip hanger or a packoff having an arrangement of profiled plates, in accordance with at least one embodiment. In at least one embodiment, a system 114 for a slip hanger (or separately, a packoff) to be used with oilfield equipment therefore includes an arrangement 344 of one or more load relief plates 336A-D to be above or below one or more profiled plates 206, 338 (or 384), 340. The one or more profiled plates 206,338 (or 384), 340 include a profile 346 that induces a change in shape in the one or more load relief plates 336A-D because of at least the indentations 348 and because of a load applied to the slip hanger. For example, the respective indentations 348 have a sharp apex 386 (sharp being distinguishable from a curved apex 366 by a person of skill upon reading the present disclosure) as part of the second angular details 380.

In at least one embodiment, distinct from aspects 330 in FIG. 3B, the first angular details 360 and the second angular details 380 also illustrate a further load relief plate 336E used with the one or more load relief plates 336A-D. The result may be a different arrangement 362 than the arrangement 344 in FIG. 3B even though the additional load relief plate may not be bent, it may provide other aspects of a specification of a slip hanger, including force resistance. In addition, the first angular details 360 and the second angular details 380 also illustrate that yet another load relief plate 368 may be provided that may be outside the arrangement 362; 382 and that may be below the compression seal 342. In at least one embodiment, distinct from aspects 330 in FIG. 3B, the second angular details 380 also illustrate that a sharp apex 386 can contribute to a different arrangement 382 than the arrangement 344 in FIG. 3B or the arrangement 362 in FIG. 3C.

In at least one embodiment, within the arrangement 344; 362; 382 of FIGS. 3B-3D, a thicker one of the load relief plates 336A-E support more force resistance, whereas a thinner one of the load relief plates 336A-E support lesser stress. A thicker one of the load relief plates may also provide more rigidity while a thinner one of the load relief plates provides more compliance, which is a spring-like compliance. Still further, with respect to the first angular details 360 and the second angular details 380, the convex or profiled indentation of the one or more profiled plates 206, 338, 340 is provided to support more compliance for an overlying or underlying load relief plate 336A-E. In at least one embodiment, each indentation 348 may be defined by a depth at its curved or sharp apex 366; 368 that is $1/15000^{th}$ times deeper with respect to an edge of the indentation.

In at least one embodiment, the compression seal 342 may include an elastomer material. The system 114 of a slip hanger or the system 124 of a packoff may include the one or more load relief plates 336A-E to a change in shape in a vertical orientation but the indentations 348, by virtue of depth till its respective apex 366; 386 allows the one or more load relief plate to change in shape under load, but to return to its shape upon release of the load. Further, the return to shape is at least to replicate a spring-like action from a change in shape to an original (or substantially original shape) of the one or more profiled plates 206, 338, 364, 384, 340.

In at least one embodiment, the one or more load relief plates 336A-E and the one or more profiled plates 206, 338, 340 extend circumferentially in the slip hanger to accommodate multiple screws 210 and to associate together the arrangement 344; 362; 382 for the slip hanger in a sandwich between the lower profiled plate 208 and the upper profiled plate 206, where the upper profiled plate 206 may be a profiled plate by virtue of indentations 348 in a bottom side profile of the upper profiled plate.

The system for a slip hanger (or separately, a packoff) may include the one or more load relief plates 336A-E and the one or more profiled plates 206, 338, 364, 384, 340 to be interchangeable and to be based in part on an application of the slip hanger or the packoff. This allows for customization, such as to enable different heights, spans, numbers, or relative placement configuration of the one or more load relief plates or of the one or more profiled plates, to be adjustable to enable compliance and deflection that are customized in accordance with an application of the slip hanger.

As illustrated in FIGS. 3C and 3D, for example, there may be a higher number of load relief plates (such as load relief plate 336E) relative to the profiled plates 206, 338, 364, 384, 340; there may be reduced height or increased height for the one or more load relief plates 336A-E; or there may be different spans for the one or more load relief plates 336A-E or the one or more profiled plates 206, 338, 364, 384, 340. In at least one embodiment, the convex or profiled indentations provide load relief along with two to three load relief plates. In at least one embodiment, the arrangement 344; 362; 382 may include one or more profiled plates 206, 338, 364, 384, 340 with profiled indentations, one or more profiled plates with convex indentations, and one or more load relief plates.

The system for a slip hanger (or separately, a packoff) may be such that the one or more load relief plates 336A-E enable resistance and stress differences. Further, the one or more profiled plates 206, 338, 340 can enable compliance for the arrangement 344; 362; 382 under the load applied to the slip hanger. In at least one embodiment, the system 114 for a slip hanger is such that the profile 346 of the one or more profiled plates 206, 338, 364, 384, 340 includes the one or more convex or other profiled indentations 348.

The system for a slip hanger (or separately, a packoff), in at least one embodiment, is such that the one or more profiled plates 206, 338, 364, 384, 340 is at least an upper profiled plate 206 and a lower profiled plate 340. The upper profiled plate is adjacent to respective heads of the screws 210 to associate together the arrangement 344 in the slip hanger. The lower profiled plate 340 is adjacent to a manually energized compression seal 342.

In at least one embodiment, the aspects 300, 330, 360, and 380 in FIGS. 3A-3D illustrate an upper end of a slip hanger with a slip bowl but without the slips, which are omitted for simplicity in the figures. However, the aspects 300, 330, 360, and 380 in FIGS. 3A-3D also illustrate a packoff, which can be a standalone system installed separately from the slip hanger to isolate pressure in the casing-casing spool annulus, or tubing hanger-tubing spool annulus. In at least one embodiment, the disclosure herein is therefore to a packoff as well as a slip hanger as described throughout herein.

Figure 4A:
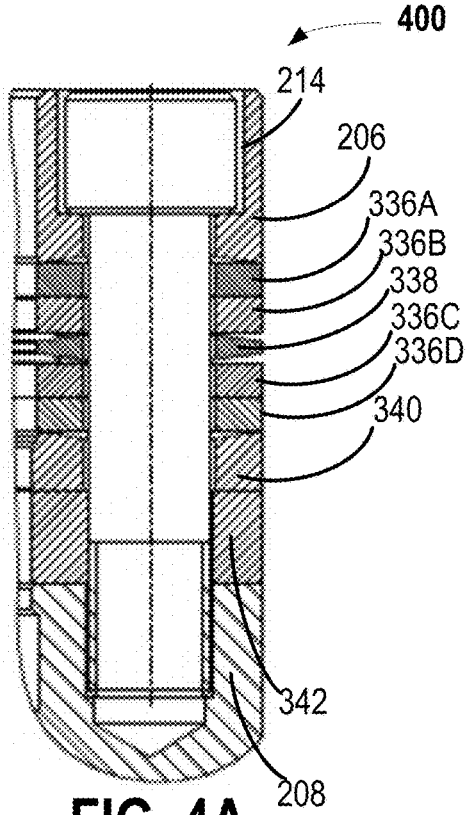
FIG. 4A is a detailed section view of aspects of a system of a slip hanger having an arrangement of profiled plates with at least one aligned screw hole, in accordance with at least one embodiment.

FIG. 4A is a detailed section view of aspects 400 of a system of a slip hanger having an arrangement of profiled plates with at least one aligned screw hole 332, in accordance with at least one embodiment. The aspects 400 illustrate that an arrangement of one or more load relief plates 336A-D, the one or more profiled plates 206, 338, 340, the compression seal 342, and the lower profiled plate 208 may all include screw holes 332 to be aligned and to receive a screw to make up the system of a slip hanger.

Figure 4B:
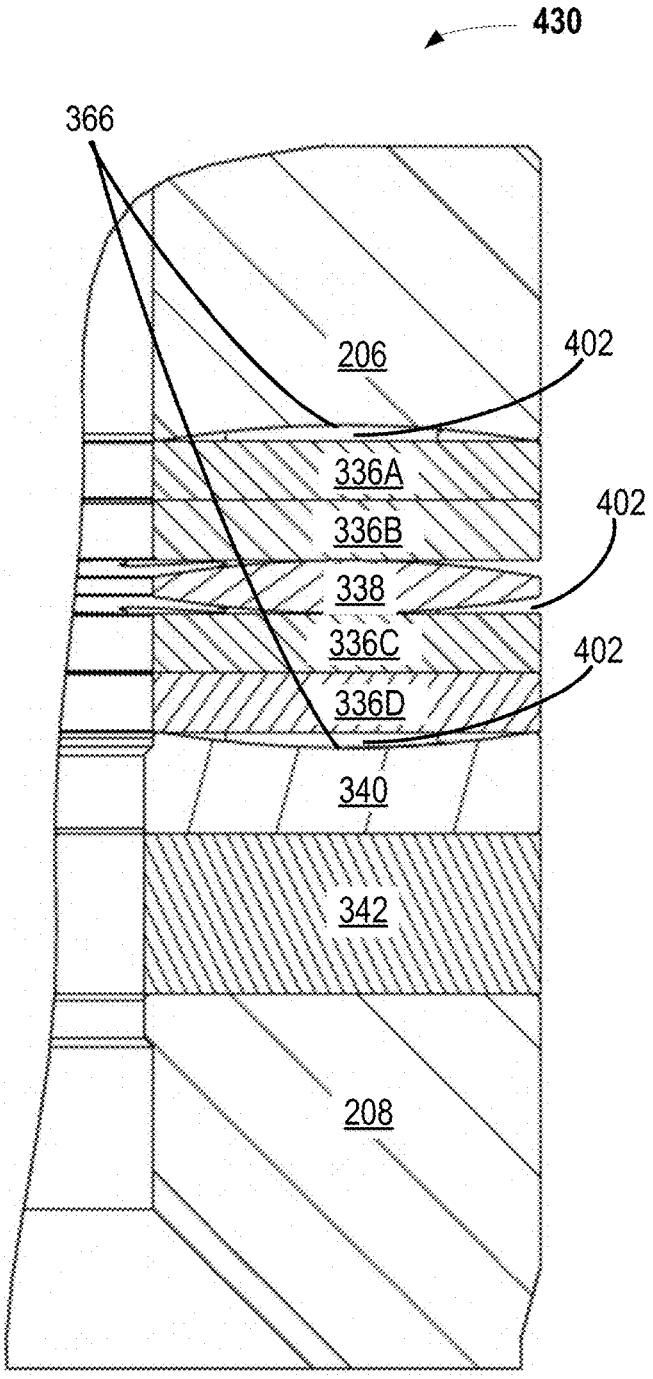
FIG. 4B is a detailed section view showing aspects of first angular areas to support a change in shape in one or more load relief plates under a load applied to a slip hanger in a system of a slip hanger having an arrangement of profiled plates, in accordance with at least one embodiment.

FIG. 4B is a detailed section view showing aspects 430 first angular areas 402 to support a change in shape in one or more load relief plates 336A-D under a load applied to a slip hanger in a system of a slip hanger having an arrangement of profiled plates 206, 338, 340, in accordance with at least one embodiment. FIG. 4B further illustrates the curved apex 366 in detail relative to a sharp apex 386 in FIG. 4D.

Figure 4C:
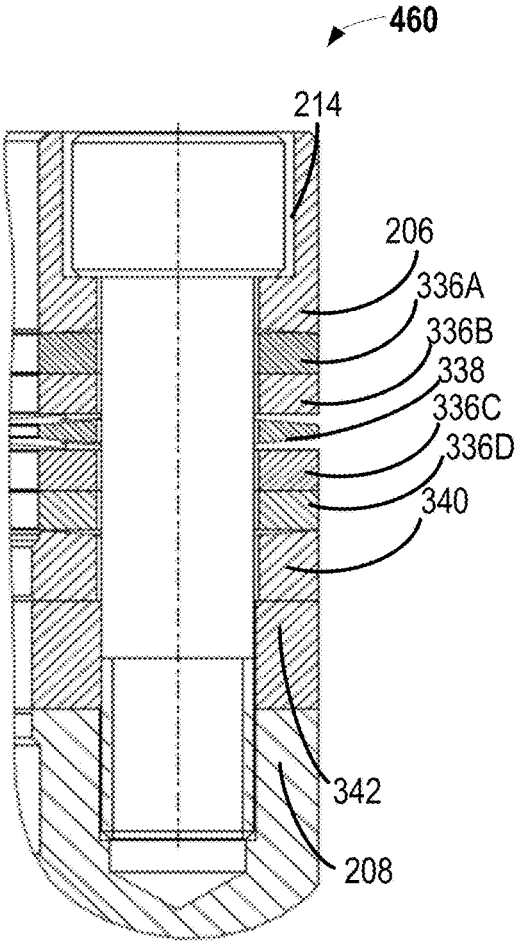
FIG. 4C is a detailed section view of aspects of another system of a slip hanger having an arrangement of profiled plates with at least one aligned screw hole, in accordance with at least one embodiment.

FIG. 4C is a detailed section view of aspects 460 of another system of a slip hanger having an arrangement of profiled plates with at least one aligned screw hole 332, in accordance with at least one embodiment. The aspects 460 illustrate that an arrangement of one or more load relief plates 336A-D, the one or more profiled plates 206, 338, 340, the compression seal 342, and the lower profiled plate 208 may all include screw holes 332 to be aligned and to receive a screw to make up the system of a slip hanger.

Figure 4D:
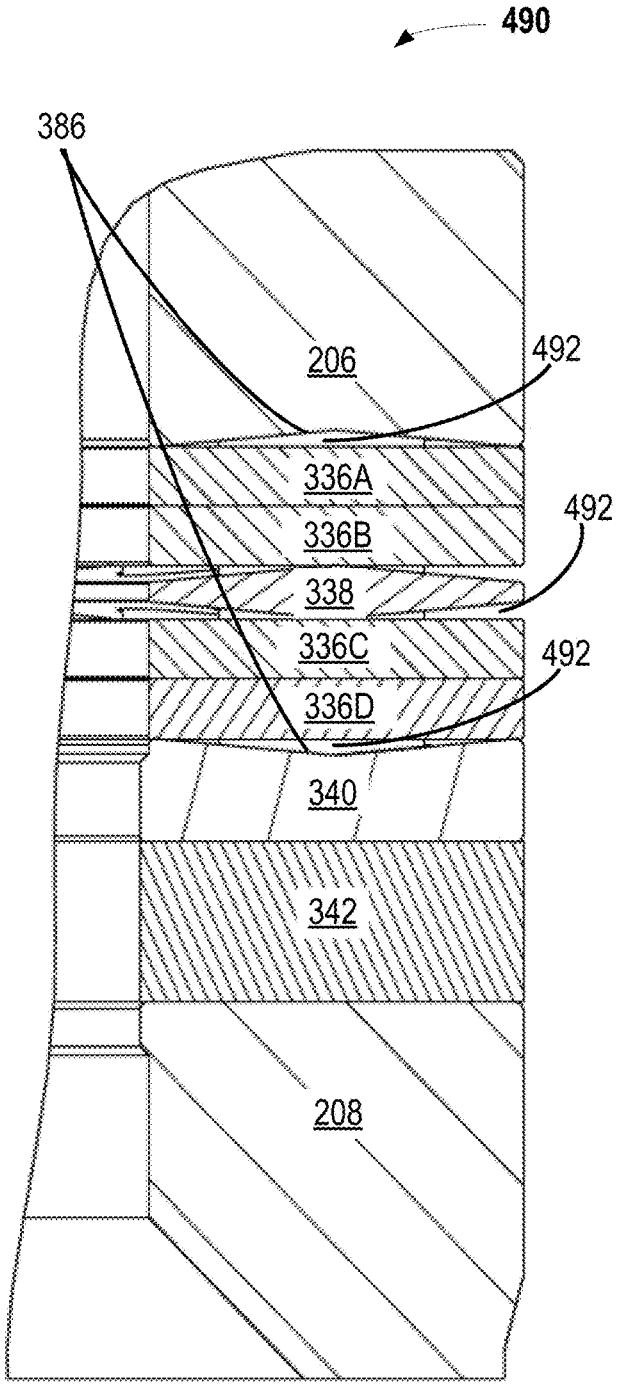
FIG. 4D is a detailed section view showing aspects of second angular areas to support a change in shape in one or more load relief plates under a load applied to a slip hanger in a system of a slip hanger having an arrangement of profiled plates, in accordance with at least one embodiment.

FIG. 4D is a detailed section view showing aspects 490 of second angular areas 492 to support a change in shape in one or more load relief plates 336A-D under a load applied to a slip hanger in a system of a slip hanger having an arrangement of profiled plates 208, 338, 340, in accordance with at least one embodiment. FIG. 4D further illustrates the sharp apex 386 in detail relative to a curved apex 366 in FIG. 4B.

Figure 5A:
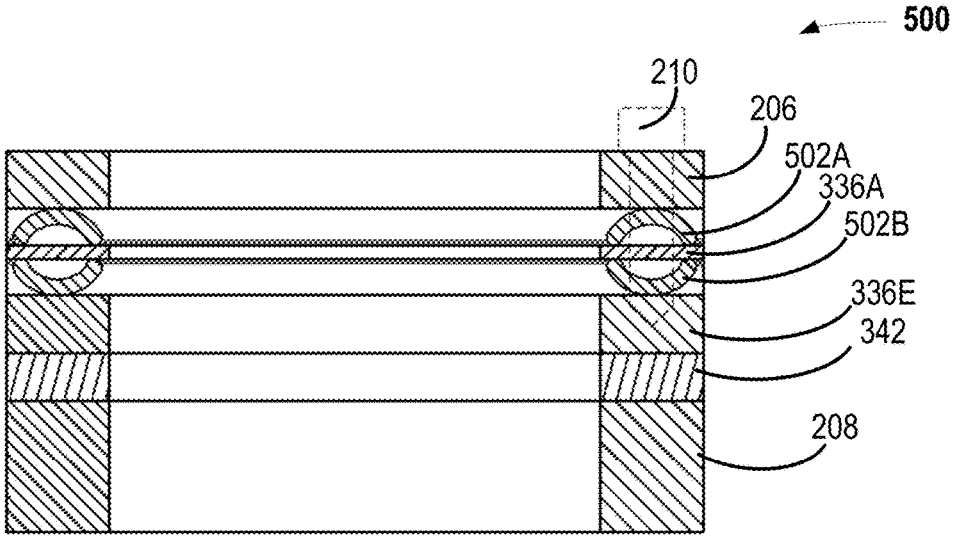
FIGS. 5A-5E illustrate cross-sections of different profiles or different arrangements of profiled plates that induce a change in shape in one or more load relief plates under a load applied to the slip hanger or the packoff, in accordance with at least one embodiment.
Figure 5B:
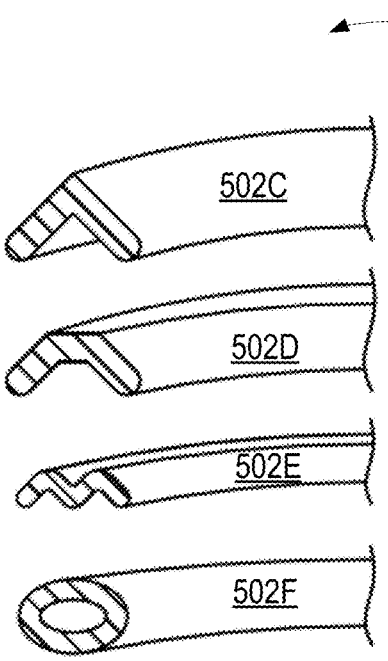
Figure 5C:
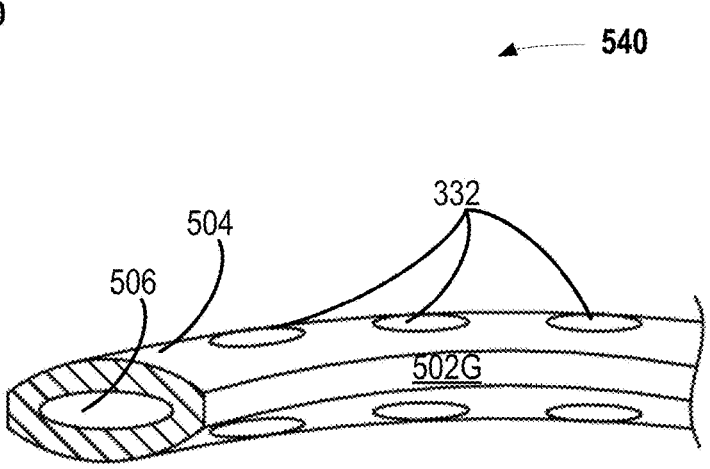

FIGS. 5A-5C illustrate cross-sections of different profiles or different arrangements 500-580 of profiled plates that induce a change in shape in one or more load relief plates under a load applied to the slip hanger or the packoff, in accordance with at least one embodiment. In FIG. 5A, a curved plate variant of a profile or a different arrangement 500 of profiled plates 502A, B that induce a change in shape in one or more load relief plates 336A, 336E under a load applied to the slip hanger or the packoff is illustrated. Such an arrangement 500 may also include a compression seal 342. FIG. 5A also illustrates the upper profiled plate 206 and a lower profiled plate 208, but with the upper profiled plate not including a profile, in at least one embodiment. FIG. 5A also illustrates that screws 210 provide coupling for at least the upper profiled plate 206 and at least one load relief plate 336A; 336E with other associations for the compression seal 342 and the lower profiled plate 208.

FIG. 5B illustrates that, instead of a curved plate variant of a profile of profiled plates 502A, B that induce a change in shape in one or more load relief plates 336A, 336E under a load applied to the slip hanger or the packoff, other shape variants 520 may be provided in the profiles of the profiled plates 502C-F. These variants 520 may enable different compliance and deflection for the slip hanger (or separately a packoff) that are customized in accordance with a specific application. In at least one embodiment, at least one variant of a profile of a profiled plate 502F may be a three-dimensional (3D) printed profiled plate.

FIG. 5C illustrates, similar to the variant of a profile of a profiled plate 502F, a further variant 540 of a hollow profiled plate 502G can induce a change in shape in one or more load relief plates 336A under a load applied to the slip hanger or the packoff. The hollow 506 portion, together with angular areas between at least one profiled plate 502F; 502G and at least one load relief plate, support a spring-like compliance from a change in shape in the one or more load relief plates 342A. FIG. 5C also illustrates screw holes 332 through a profiled plate 502G to enable the coupling using a screw 210, from at least the upper profiled plate 206 of an arrangement of such plates, to at least one load relief plate 336A; but may be also with other associations for the compression seal 342 and the lower profiled plate 208. Further, FIGS. 5B and 5C illustrate different geometries in the hollow 506 portion as well to provide a different shape in the top or bottom surfaces 504 of one profiled plate 502F with respect to another profiled plate 502G. In at least one embodiment, the profiled plate 502G; F may be a 3D printed profiled plate.

Figure 5D:
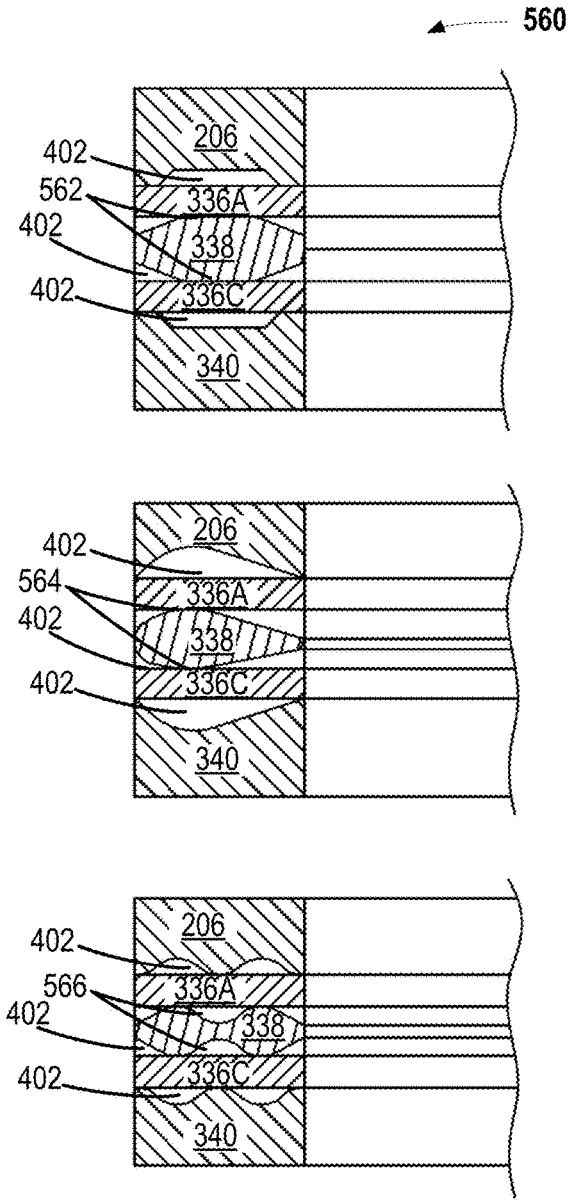

In FIG. 5D, different profiles and different arrangements 560 of profiled plates 338, B that induce a change in shape in one or more load relief plates 336A, 336C under a load applied to the slip hanger or the packoff is illustrated. FIG. 5A also illustrates the upper profiled plate 206 and a lower load relief plate 336E, where at least the upper profiled plate 206, differently from the profiles and arrangements 500, includes a profile, in at least one embodiment. There are angular areas 402 between at least one profiled plate 338 and at least one load relief plate 336A, C to support a spring-like compliance from a change in shape in the one or more load relief plates 336A, C. Such arrangements 560 may not include a compression seal 342.

FIG. 5D also illustrates different apex of the angular areas 402. In one of the different profiles and different arrangements 560, the apex 562 may be a flat bottom or top; in another one of the different profiles and different arrangements 560, the apex 564 may be off-center with respect to an area of volume of the indentation therein; and in yet another one of the different profiles and different arrangements 560, the indentations on the profiled plates may be multiple humps 566.

Figure 5E:
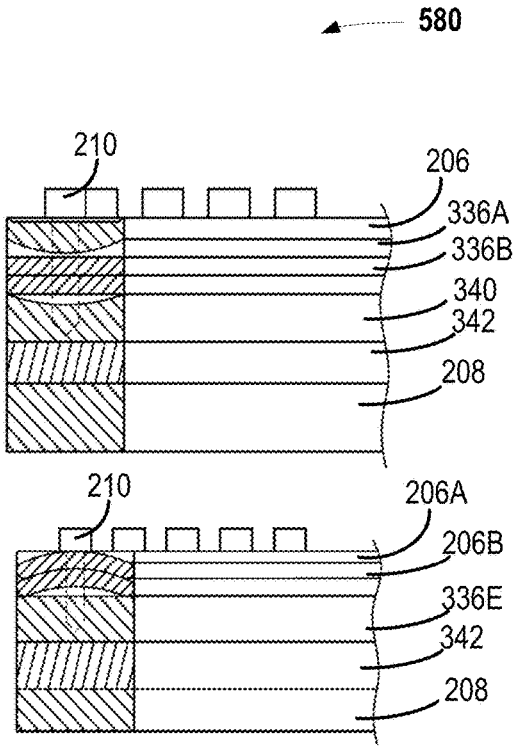

In FIG. 5E, still further variants of profiles or arrangements 580 of profiled plates may be provided by the upper profiled plate 206; 206A; 206B itself, where these upper profiled plates have at least a profile (though both sides of an upper profiled plate 206 allows for different profiles as illustrates) induce a change in shape in one or more load relief plates 336A, 336B under a load applied to a slip hanger or a packoff having such variants of profiles or arrangements 580. FIG. 5E illustrates that an upper profiled plate 206 may have a first part of a profile on a top surface and a second part of a profile on a bottom surface. There may be one or more angular areas defined by such a profile. A lower profiled plate 208 may not include a profile, in at least one embodiment; but a lower profiled plate 340 may include a profile, in at least one embodiment. Further, a compression seal 342 can be also provided in at least one of such arrangements 580. FIG. 5E also illustrates that, in such arrangements 580, screws 210 provide coupling for at least the upper profiled plate 206; 206A, 206B and at least one load relief plate 336A; 336B; 336E with other associations for a lower profiled plate 340, a compression seal 342. and the lower profiled plate 208.

Figure 6A:
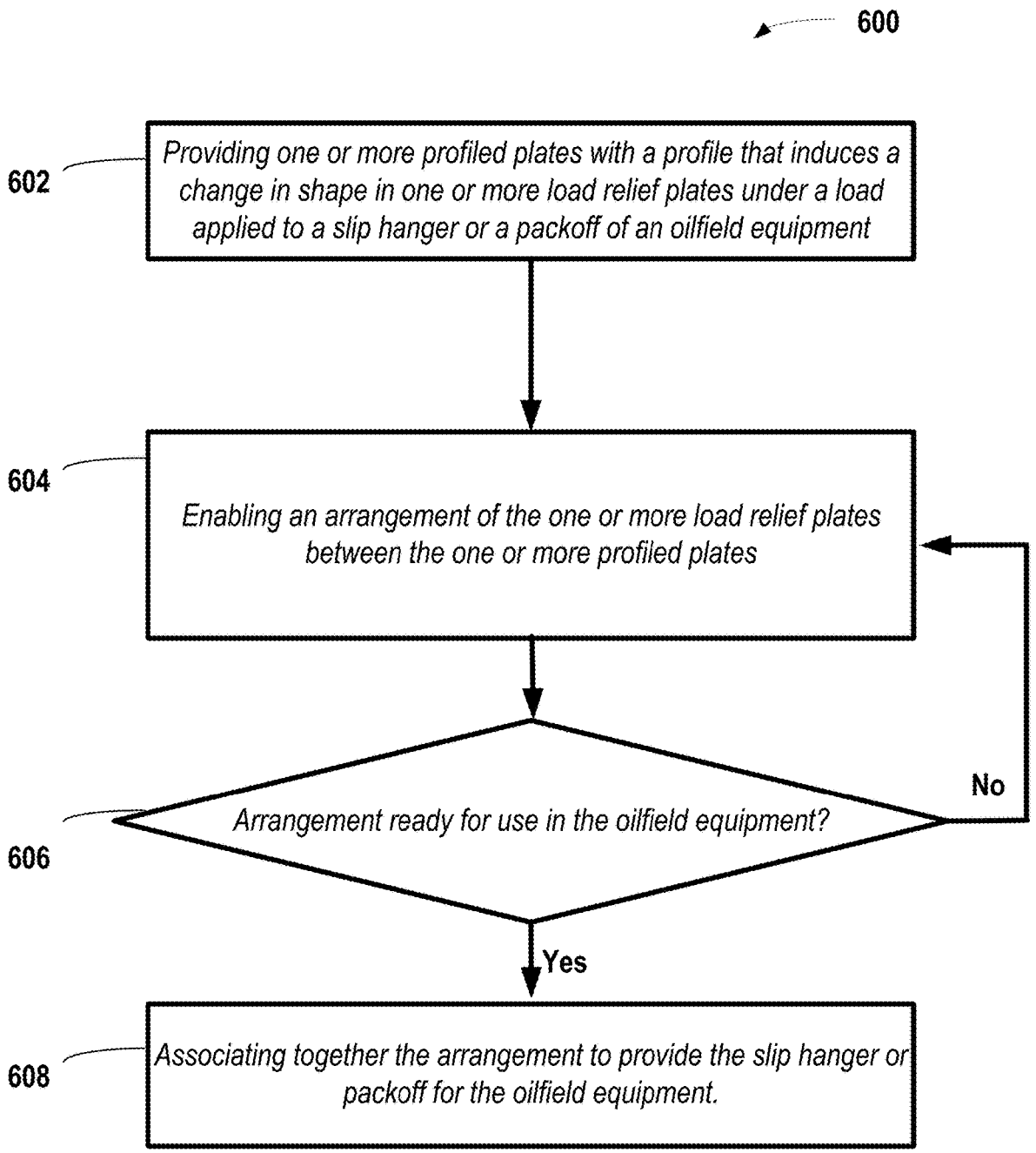
FIG. 6A is a flow diagram of a method for a system of a slip hanger having an arrangement of profiled plates that is described at least in FIGS. 1-4D herein, in accordance with at least one embodiment.

FIG. 6A is a flow diagram of a method 600 for a system of a slip hanger or a packoff having an arrangement of profiled plates that is described at least in FIGS. 1-4D herein, in accordance with at least one embodiment. The method 600 may be for a slip hanger or the packoff to be used with an oilfield equipment. The method 600 includes providing (602) one or more profiled plates with a profile that induces a change in shape in one or more load relief plates under a load applied to the slip hanger. For example, indentations may be provided throughout a circumference of the one or more profiled plates, in one or more sides forming the profile.

The method 600 includes enabling (604) an arrangement of the one or more load relief plates above or below the one or more profiled plates. The arrangement may be associated with an application of the slip hanger. The arrangement may include ensuring that a number of the one or more load relief plates and a number of one or more profiled plates, along with their respective thickness, spans, and other aspects, are selected to meet the specifications of the application and are arranged together. A verification (606) may be performed that the arrangement is ready for use in the slip hanger. The verification may include that aligning of the one or more load relief plates and the one or more profiled plates is properly completed so that screws may be threaded through the aligned screw holes. The method 600 includes associating (608) together the arrangement, such as by threading the screws to a determined torque, to provide the slip hanger or the packoff.

In at least one embodiment, the method 600 includes a further step or includes a sub-step for providing a manually energized compression seal to be located adjacent to the arrangement. The manually energized compression seal can include an elastomer material. In at least one embodiment, the method 600 includes a further step or includes a sub-step for enabling the one or more load relief plates to change in shape in a vertical orientation. This may be by ensuring, at the time of providing (602) the one or more profiled plates, that the indentations sufficiently allow a change in shape in the vertical orientation for the load relief plates that are associated with such one or more profiled plates.

In at least one embodiment, the method 600 includes a further step or includes a sub-step for enabling the one or more load relief plates and the one or more profiled plates to extend circumferentially in the slip hanger. This may be by aligning multiple sections of each of the one or more load relief plates and each of the one or more profiled plates with the slip hanger prior to the associating (608) step. Further, the sections are such that they are intended to extend circumferentially in the slip hanger or the packoff.

In at least one embodiment, the method 600 includes a further step or includes a sub-step for using multiple screws to perform the associating together of the arrangement for the slip hanger in the associating (608) step. In at least one embodiment, the method 600 includes a further step or includes a sub-step for enabling the one or more load relief plates to be interchangeable and the one or more profiled plates to be interchangeable. This may be performed as part of the providing (602) step in the method 600.

In at least one embodiment, the method 600 includes determining an application of the slip hanger or packoff. The method 600 includes selecting the one or more load relief plates and the one or more profiled plates from a first set of one or more load relief plates and from a second set of one or more profiled plates as part of the providing (602) step. Further, the first set of one or more load relief plates and the second set of one or more profiled plates include different heights and different spans.

In at least one embodiment, the selecting of the one or more load relief plates and of the one or more profiled plates, as part of the providing (602) step, includes selecting a number or a relative placement configuration of the one or more load relief plates or of the one or more profiled plates to enable compliance and deflection that are customized in accordance with the application of the slip hanger. The compliance and deflection may be part of the specifications of the application provided for the slip hanger or the packoff.

In at least one embodiment, the one or more load relief plates enable resistance and stress differences for an application and may be part of the specifications, whereas the one or more profiled plates enable compliance and deflection of the specifications. The one or more profiled plates can enable compliance for the arrangement under the load applied to the slip hanger, according to the specifications. In at least one embodiment, a profile of the one or more profiled plates includes one or more convex or profiled indentations to meet the compliance and deflection described in the specifications for the application.

Figure 6B:
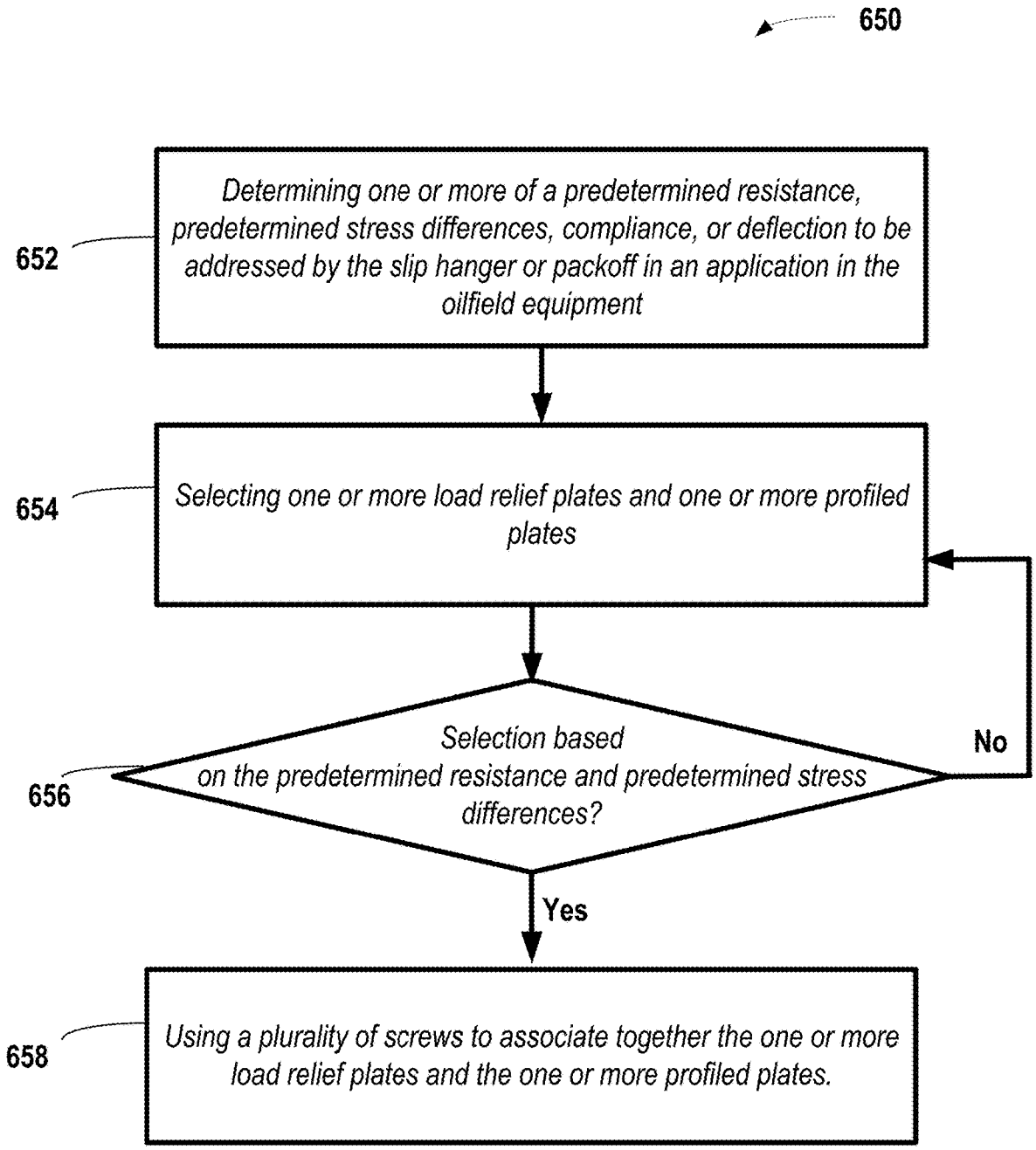
FIG. 6B is a flow diagram of a method for using a system of a slip hanger having an arrangement of profiled plates that is described at least in FIGS. 1-4D herein, in accordance with at least one embodiment.

FIG. 6B is a flow diagram of a method 660 for using a system of a slip hanger or a packoff having an arrangement of profiled plates that is described at least in FIGS. 1-4D herein, in accordance with at least one embodiment. The method 660 may be for using a slip hanger or a packoff in an oilfield equipment. The method 650 includes determining (652) one or more of a predetermined resistance, predetermined stress differences, a deflection, or a compliance to be addressed by the slip hanger in an application for the slip hanger or to be addressed by a packoff in the oilfield equipment. The method 650 includes selecting (654) one or more load relief plates and one or more profiled plates to be associated together. The method 650 includes verifying (656) that the selecting of step 654 is based in part on the determining in step 652. The method 650 includes using (658) multiple screws to associate together the one or more load relief plates and the one or more profiled plates.

In at least one embodiment, the method 600 includes a further step or includes a sub-step for providing a manually energized compression seal to be located adjacent to the arrangement. In at least one embodiment, the method 600 includes a further step or includes a sub-step for adjusting the screws with the manually energized compression seal. For example, a predetermined amount of torque may be applied to the screws to enable the slip hanger or packoff to be used in the application where further load of the application is expected. In at least one embodiment, the method 600 includes a further step or includes a sub-step for providing the slip hanger or the packoff, the one or more load relief plates, and the one or more profiled plates as sections to be associated together around a casing string.

While techniques herein may be subject to modifications and alternative constructions, these variations are within spirit of present disclosure. As such, certain illustrated embodiments are shown in drawings and have been described above in detail, but these are not limiting disclosure to specific form or forms disclosed; and instead, cover all modifications, alternative constructions, and equivalents falling within spirit and scope of disclosure, as defined in appended claims.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment", "an embodiment", "certain embodiments," or "other embodiments" of the present invention are not intended to be interpreted as excluding the existence of additional embodiments that also incorporate the recited features. Furthermore, reference to terms such as "above," "below," "upper", "lower", "side", "front," "back," or other terms regarding orientation are made with reference to the illustrated embodiments and are not intended to be limiting or exclude other orientations.

Recitation of ranges of values herein are merely intended to serve as a shorthand method of referring individually to each separate value falling within range, unless otherwise indicated herein and each separate value is incorporated into specification as if it were individually recited herein. In at least one embodiment, use of a term, such as a set (for a set of items) or subset unless otherwise noted or contradicted by context, is understood to be nonempty collection including one or more members. Further, unless otherwise noted or contradicted by context, term subset of a corresponding set does not necessarily denote a proper subset of corresponding set, but subset and corresponding set may be equal.

Conjunctive language, such as phrases of form, at least one of A, B, and C, or at least one of A, B and C, unless specifically stated otherwise or otherwise clearly contradicted by context, is otherwise understood with context as used in general to present that an item, term, etc., may be either A or B or C, or any nonempty subset of set of A and B and C. In at least one embodiment of a set having three members, conjunctive phrases, such as at least one of A, B, and C and at least one of A, B and C refer to any of following sets: {A}, {B}, {C}, {A, B}, {A, C}, {B, C}, {A, B, C}. Thus, such conjunctive language is not generally intended to imply that certain embodiments require at least one of A, at least one of B and at least one of C each to be present. In addition, unless otherwise noted or contradicted by context, terms such as plurality, indicates a state of being plural (such as, a plurality of items indicates multiple items). In at least one embodiment, a number of items in a plurality is at least two but can be more when so indicated either explicitly or by context. Further, unless stated otherwise or otherwise clear from context, phrases such as based on means based at least in part on and not based solely on.

In at least one embodiment, even though the above discussion provides at least one embodiment having implementations of described techniques, other architectures may be used to implement described functionality, and are intended to be within scope of this disclosure. In addition, although specific responsibilities may be distributed to components and processes, they are defined above for purposes of discussion, and various functions and responsibilities might be distributed and divided in different ways, depending on circumstances.

In at least one embodiment, although subject matter has been described in language specific to structures and/or methods or processes, it is to be understood that subject matter claimed in appended claims is not limited to specific structures or methods described. Instead, specific structures or methods are disclosed as example forms of how a claim may be implemented.

From all the above, a person of ordinary skill would readily understand that the tool of the present disclosure provides numerous technical and commercial advantages and can be used in a variety of applications. Various embodiments may be combined or modified based in part on the present disclosure, which is readily understood to support such combination and modifications to achieve the benefits described above.

It should be appreciated that embodiments herein may utilize one or more values that may be experimentally determined or correlated to certain performance characteristics based on operating conditions under similar or different conditions. The present disclosure described herein, therefore, is well adapted to carry out the objects and attain the ends and advantages mentioned, as well as others inherent therein. While a presently preferred embodiment of the disclosure has been given for purposes of disclosure, numerous changes exist in the details of procedures for accomplishing the desired results. These and other similar modifications will readily suggest themselves to those skilled in the art and are intended to be encompassed within the spirit of the present disclosure disclosed herein and the scope of the appended claims.

What is claimed is:

1. A system for a slip hanger or a packoff to be used with oilfield equipment, comprising:

an arrangement, comprising:

one or more load relief plates to be above or below one or more profiled plates, the one or more profiled plates comprising a profile of indentations that are circumferentially provided in the one or more profiled plates and that induces a change in shape, in a vertical orientation which is along a wellbore, in the one or more load relief plates under a load applied from a thermal expansion to the slip hanger or the packoff, wherein a first profiled plate of the one or more profiled plates comprises one or more screw holes; and one or more screws provided in the one or more screw holes, the one or more screws arranged parallel to the vertical orientation and the one or more screws extending through at least the first profiled plate and a first load relief plate of the one or more load relief plates.

2. The system of claim 1, further comprising:

a manually energized compression seal located adjacent to the arrangement, the manually energized compression seal to be comprised of an elastomer material.

3. The system of claim 1, further comprising:

the one or more load relief plates to deform, as part of the change in the shape and in addition to the change in the vertical orientation, the deformation in one or more of a circumferential orientation or a radial orientation.

4. The system of claim 1, further comprising:

the one or more load relief plates and the one or more profiled plates to extend circumferentially in the slip hanger to accommodate the one or more a plurality of screws to associate together the arrangement for the slip hanger or the packoff.

5. The system of claim 1, further comprising:

the one or more load relief plates to be interchangeable and the one or more profiled plates to be interchangeable, based in part on an application of the slip hanger or the packoff.

6. The system of claim 1, further comprising:

a height, a span, a number, or a relative placement configuration of the one or more load relief plates or of the one or more profiled plates to be adjustable to enable compliance and deflection that are customized in accordance with an application of the slip hanger or the packoff, wherein the change in the shape of the one or more load relief plates is to provide a changed shape representing the compliance and which is at least partly within a space formed by the profile of the one or more profiled plates.

7. The system of claim 1, wherein the one or more load relief plates enable resistance and stress differences and wherein the one or more profiled plates enable compliance for the arrangement, in part by the change in the shape of the one or more load relief plates to provide a changed shape that is at least partly within a space formed by the profile of the one or more profiled plates, under the load applied to the slip hanger or packoff.

8. The system of claim 1, wherein the profile of the one or more profiled plates comprises one or more indentations.

9. The system of claim 1, wherein the one or more profiled plates is at least an upper profiled plate and a lower profiled plate, wherein the upper profiled plate is adjacent to respective heads of the one or more screws to associate together the arrangement in the slip hanger and wherein the lower profiled plate is adjacent to a manually energized compression seal.

10. A method for a slip hanger or a packoff to be used with an oilfield equipment, comprising:

providing one or more profiled plates with a profile of indentations that are circumferentially provided in the one or more profiled plates and that induces a change in shape, in at least a vertical orientation which is along a wellbore, in one or more load relief plates under a load applied from a thermal expansion to the slip hanger or the packoff, wherein a first profiled plate of the one or more profiled plates comprises one or more screw holes;

enabling an arrangement of the one or more load relief plates above or below the one or more profiled plates;

associating together the arrangement to provide the slip hanger or the packoff; and providing one or more screws in the one or more screw holes, the one or more screws arranged parallel to the vertical orientation and the one or more screws extending through at least the first profiled plate and a first load relief plate of the one or more load relief plates.

11. The method of claim 10, further comprising:

providing a manually energized compression seal to be located adjacent to the arrangement, the manually energized compression seal to be comprised of an elastomer material.

12. The method of claim 10, further comprising:

enabling the one or more load relief plates to deform, as part of the change in the shape and in addition to the change in the vertical orientation, the deformation in one or more of a circumferential orientation or a radial orientation.

13. The method of claim 10, further comprising:

enabling the one or more load relief plates and the one or more profiled plates to extend circumferentially in the slip hanger or the packoff; and using the one or more screws to perform the associating together of the arrangement for the slip hanger or the packoff.

14. The method of claim 10, further comprising:

enabling the one or more load relief plates to be interchangeable and the one or more profiled plates to be interchangeable;

determining an application of the slip hanger or the packoff; and selecting the one or more load relief plates and the one or more profiled plates from a first set of one or more load relief plates and from a second set of one or more profiled plates.

15. The method of claim 14, wherein the first set of one or more load relief plates and the second set of one or more profiled plates comprise different heights and different spans, and wherein the selecting of the one or more load relief plates and of the one or more profiled plates comprises selecting a number or a relative placement configuration of the one or more load relief plates or of the one or more profiled plates to enable compliance and deflection that are customized in accordance with the application of the slip hanger or the packoff, wherein the change in the shape of the one or more load relief plates is to provide a changed shape representing the compliance and which is at least partly within a space formed by the profile of the one or more profiled plates.

16. The method of claim 10, wherein the one or more load relief plates enable resistance and stress differences and wherein the one or more profiled plates enable compliance for the arrangement, in part by the change in the shape of the one or more load relief plates to provide a changed shape that is at least partly within a space formed by the profile of the one or more profiled plates, under the load applied to the slip hanger or the packoff.

17. The method of claim 10, wherein the profile of the one or more profiled plates comprises one or more indentations.

18. A method for using a slip hanger or packoff in an oilfield equipment, the method comprising:

determining, based in part on a provided specifications for the slip hanger or the packoff to address an application in the oilfield equipment, one or more of a predetermined resistance, predetermined stress differences, a compliance, or a deflection to be addressed by the slip hanger or the packoff in the application;

associating together one or more load relief plates and one or more profiled plates to provide the slip hanger or the packoff for use in the oilfield equipment, the one or more load relief plates and the one or more profiled plates associated together based in part on the one or more of the predetermined resistance, the predetermined stress differences, the compliance, or the deflection;

inducing a change in shape for the one or more load relief plates, the change in the shape being in a vertical orientation along a wellbore and induced using one or more profiled plates comprising a profile of indentations that are circumferentially provided in the one or more profiled plates and under a load from a thermal expansion to the slip hanger or packoff, wherein a first profiled plate of the one or more profiled plates comprises one or more screw holes; and providing one or more screws in the one or more screw holes, the one or more screws arranged parallel to the vertical orientation and the one or more screws extending through at least the first profiled plate and a first load relief plate of the one or more load relief plates.

19. The method of claim 18, further comprising:

providing a manually energized compression seal to be located adjacent to the one or more load relief plates; and adjusting, using the one or more screws, the manually energized compression seal to provide an initial load prior to application of the slip hanger or packoff in the oilfield equipment.

20. The method of claim 18, further comprising:

providing the slip hanger or the packoff, the one or more load relief plates, and the one or more profiled plates as sections to be associated together around a casing string.

* * * * *